US006821114B2

(12) United States Patent
Kisoda

(10) Patent No.: US 6,821,114 B2
(45) Date of Patent: Nov. 23, 2004

(54) GAS-COOLED SINGLE CHAMBER HEAT TREATING FURNACE, AND METHOD FOR GAS COOLING IN THE FURNACE

(75) Inventor: Kinya Kisoda, Izumiohtsu (JP)

(73) Assignee: Chugai Ro Co., Ltd., Osaka (JP)

( * ) Notice: Subject to any disclaimer, the term of this patent is extended or adjusted under 35 U.S.C. 154(b) by 7 days.

(21) Appl. No.: 10/239,894

(22) PCT Filed: Dec. 26, 2001

(86) PCT No.: PCT/JP01/11421

§ 371 (c)(1),
(2), (4) Date: Oct. 24, 2002

(87) PCT Pub. No.: WO02/066687

PCT Pub. Date: Aug. 29, 2002

(65) Prior Publication Data

US 2004/0009448 A1 Jan. 15, 2004

(30) Foreign Application Priority Data

Feb. 22, 2001 (JP) ..... 2001-46614
May 14, 2001 (JP) ..... 2001-143299

(51) Int. Cl.[7] ..... F27D 15/02
(52) U.S. Cl. ..... 432/81; 432/77; 432/176
(58) Field of Search ..... 432/48, 77, 81, 432/4, 233, 253, 173, 176

(56) References Cited

U.S. PATENT DOCUMENTS 3,565,410 A * 2/1971 Scherff ..... 266/250
4,239,484 A * 12/1980 Schuster ..... 432/77
4,560,348 A * 12/1985 Moller et al. ..... 432/77
4,836,776 A * 6/1989 Jomain ..... 432/176
4,854,863 A * 8/1989 Hemsath ..... 432/176
4,906,182 A * 3/1990 Moller ..... 432/77
5,290,189 A * 3/1994 Hemsath et al. ..... 432/242

FOREIGN PATENT DOCUMENTS

| | | |
|---|---|---|
| JP | 52-119408 | 10/1977 |
| JP | 5-34846 Y2 | 9/1993 |
| JP | 6-88122 A | 3/1994 |
| JP | 7-208876 A | 8/1995 |
| JP | 2565021 Y2 | 11/1997 |
| JP | 2808632 B2 | 7/1998 |

* cited by examiner

*Primary Examiner*—Gregory Wilson
(74) *Attorney, Agent, or Firm*—Birch, Stewart, Kolasch & Birch, LLP

(57) ABSTRACT

A gas-cooled single-chamber type heat-treating furnace T in which cooling gas vents 9A and 9B opened and closed by doors 11A and 11B are provided on each of mutually opposed walls of an inner chamber 5 forming a processing room and cooling gas is circulated by opening the cooling gas vents 9A and 9B during gas cooling, wherein the cooling gas vents 9A and 9B of the inner chamber 5 are provided with lattice-shaped flow uniforming members 19 made of heat-resisting materials.

6 Claims, 4 Drawing Sheets

GAS-COOLED SINGLE CHAMBER HEAT TREATING FURNACE, AND METHOD FOR GAS COOLING IN THE FURNACE

This application is the national phase under 35 U.S.C. § 371 of PCT International Application No. PCT/JP01/11421 which has an International filing date of Dec. 26, 2001, which designated the United States of America.

TECHNICAL FIELD

The present invention relates to a gas-cooled single-chamber type heat-treating furnace for heat-treating metallic materials such as steel parts and a gas cooling method in the furnace.

BACKGROUND OF THE INVENTION

The gas-cooled single-chamber type heat-treating furnace is known as a furnace for cooling metallic materials by the forced circulation of cooling gas after heating the metallic materials.

In this gas-cooled single-chamber type heat-treating furnace, cooling gas vents opened and closed by doors are provided on each of mutually opposed walls of an inner chamber, namely a processing room provided in a casing. The cooling gas vents are closed by the doors when the metallic materials are heated, and then the metallic materials charged into the inner chamber are heated by a heater provided in the inner chamber. When the heated metallic materials are cooled, the cooling gas vents are opened, and then cooling gas cooled by a cooler is supplied into the inner chamber from one cooling gas vent by means of a circulating fan provided in the casing and is directed to the circulating fan from the other cooling gas vent, whereby the metallic materials are cooled during the circulation of this cooling gas.

The cooling gas vents have a large opening area so as to supply a sufficient amount of cooling gas to the metallic materials in the inner chamber, and are opened and closed by sliding or lifting doors.

In the above conventional gas-cooled single-chamber type heat-treating furnace, each of the cooling gas vents has simply an opening. Therefore, a flow of the cooling gas in the inner chamber during cooling is inclined to concentrate on a center portion of the cooling gas vents, so that the metallic materials cannot be cooled uniformly.

Furthermore, in case a sliding doors are employed which move in parallel along the cooling gas vents, it is required to minimize a clearance between the doors and the inner chamber to enhance a sealing performance of the doors during the inner chamber is closed. However, if this clearance is made too small, the inner chamber does not operate properly due to a slight thermal strain of the doors or the inner chamber, whereby good sealing performance cannot be maintained for a long time. As a result, such a problem arises that the temperature distribution in the inner chamber becomes uneven during heating.

In case the lifting doors are employed, enough sealing performance cannot be maintained due to a thermal strain of the cooling gas vents of the inner chamber. This also causes a problem of uneven temperature distribution in the inner chamber.

The present invention has for its object to provide a gas-cooled single-chamber type heat-treating furnace in which a flow of the cooling gas in the inner chamber during cooling is not inclined to concentrate on the center portion of the cooling gas vents. In addition, the present invention has for its object to provide a gas-cooled single-chamber type heat-treating furnace in which good sealing performance is maintained between the doors and the inner chamber.

In the meantime, a gas cooling method has been known as a cooling method in the heat treatment of metallic materials. Furthermore, with respect to a cooling treatment, such a cooling method has been known that, for example, a metallic material kept at a hardening temperature is rapidly cooled in the critical temperature range to a temperature just above the martensitic transformation starting temperature and is slowly cooled, conversely, in the dangerous temperature range at or below the martensitic transformation starting temperature.

The gas cooling method mentioned above is roughly classified into an internal circulation type (in which a circulating fan is provided inside the furnace) and an external circulation type (in which a circulating blower is provided outside the furnace). In any one of the above types metallic materials of different classes or shapes can be heat-treated in the same furnace. Therefore, according to the above-mentioned gas cooling method, cooling based on a proper temperature pattern corresponding to a class or a shape of each metallic material becomes necessary so as to reduce a strain of the metallic material and achieve an expected object.

Furthermore, a forced convection cooling method is known, in which a gas density of a circulated atmosphere changes in response to a temperature change in the circulated atmosphere whereby a heat transfer coefficient changes. That is, a cooling effect lowers under a condition of a constant number of revolutions of a fan because a gas density is low when atmosphere temperature is high during an initial period of cooling. In order to eliminate this problem, there is proposed a method for improving the cooling effect by running the circulating fan or the circulating blower at a high speed in response to a change in the furnace atmosphere temperature or metallic material temperature in the furnace (Japanese Patent Laid-open Publication No.52-119408).

In case the forced convection cooling method, such a problem arises that cooling in response to a preset cooling curve cannot be achieved because only the number of revolutions of the fan is changed directly on the basis of the furnace atmosphere temperature or the metallic material temperature in the furnace.

In addition, a capacity of the drive motor of the circulating fan in the internal circulation type or that of the circulating blower in the external circulation type is determined in consideration of a furnace capacity, efficiency and soon. Thus, such a problem arises that the drive motor may run over its rated number of revolutions in a specific cooling state, whereby a risk of burning of the drive motor occurs.

The present invention, therefore, has for its object to provide a cooling method of a metallic material, in which in order to solve above mentioned problems, the drive motor exhibits a maximum cooling capacity by running the drive motor at an allowable critical power when a preset cooling speed is higher than an actual cooling speed, while otherwise the cooling speed of the metallic material is adjusted through control of a number of revolutions of the drive motor such that the furnace atmosphere temperature or the temperature of the metallic material in the furnace will change at the preset cooling speed.

SUMMARY OF THE INVENTION

In order to achieve the above objects, according to the present invention, there is provided a gas-cooled single-chamber type heat-treating furnace in which cooling gas vents opened and closed by doors are provided on each of mutually opposed walls of an inner chamber forming a processing room and a cooling gas is circulated by opening the cooling gas vents during gas cooling, wherein the cooling gas vents of the inner chamber are provided with lattice-shaped flow uniforming members of heat-resisting materials.

Thus, the cooling gas vents of the inner chamber are provided with lattice-shaped uniforming members, thereby the flow of an incoming gas into the inner chamber and an outgoing gas from the inner chamber are controlled, thereby resulting in reducing the flow of cooling gas in the inner chamber inclined to concentrate on the center of the cooling gas vents in the inner chamber, so that the metallic materials can be cooled uniformly.

Furthermore, in the gas-cooled single-chamber type heat-treating furnace according to the present invention, the cooling gas vents are at an upper portion and a lower portion of the inner chamber and the doors are of a lifting type, and a pressing contact portion between a peripheral portion of each door and the inner chamber has a structure in which a projection is held in engagement with a recess.

Thus, since the pressing contact portion formed at peripheral portions of the each door and the each cooling gas vent of the inner chamber has a structure in which a projection is held in engagement with a recess, sealing performance is secured even if a clearance occurs between a tip portion of the projection and the recess due to thermal expansion etc., and the temperature distribution in the inner chamber is not disturbed.

Meanwhile, it is preferable to make the lattice-shaped flow uniforming members of thin plates of carbon graphite fiber composite.

By making the lattice-shaped flow uniforming members of thin plates of carbon graphite fiber composite, the lattice-shaped flow uniforming members have a small volume of heat storage and great strength. Therefore, the responsiveness during heating and cooling is never damaged, and an effect that a flow of great volume of cooling gas can be obtained without any obstruction.

Furthermore, in order to achieve the above objects, according to the present invention, there is provided a gas cooling method in a gas-cooled single-chamber type heat-treating furnace in which a metallic material heated to a predetermined temperature is cooled by forced convection, wherein a number of revolutions of a drive motor of a circulating fan or a circulating blower is controlled based on a difference between a preset cooling curve and an atmosphere temperature in an inner chamber or a metallic material temperature obtained by comparing the atmosphere temperature or the metallic material temperature with the preset cooling curve; wherein the drive motor is kept to run at its critical output even if a load increases due to a temperature change when an output of the drive motor reaches the critical output.

Thus, since the number of revolutions of the drive motor of the circulating fan or circulating blower is controlled by a temperature feedback and an output feedback, the maximum cooling capacity can be achieved during rapid cooling, while a cooling process corresponding to the preset cooling curve is performed during slow cooling.

DETAILED DESCRIPTION OF THE PREFERRED EMBODIMENT

Hereinafter, embodiments of the present invention are described with reference to the drawings.

Figure 1:
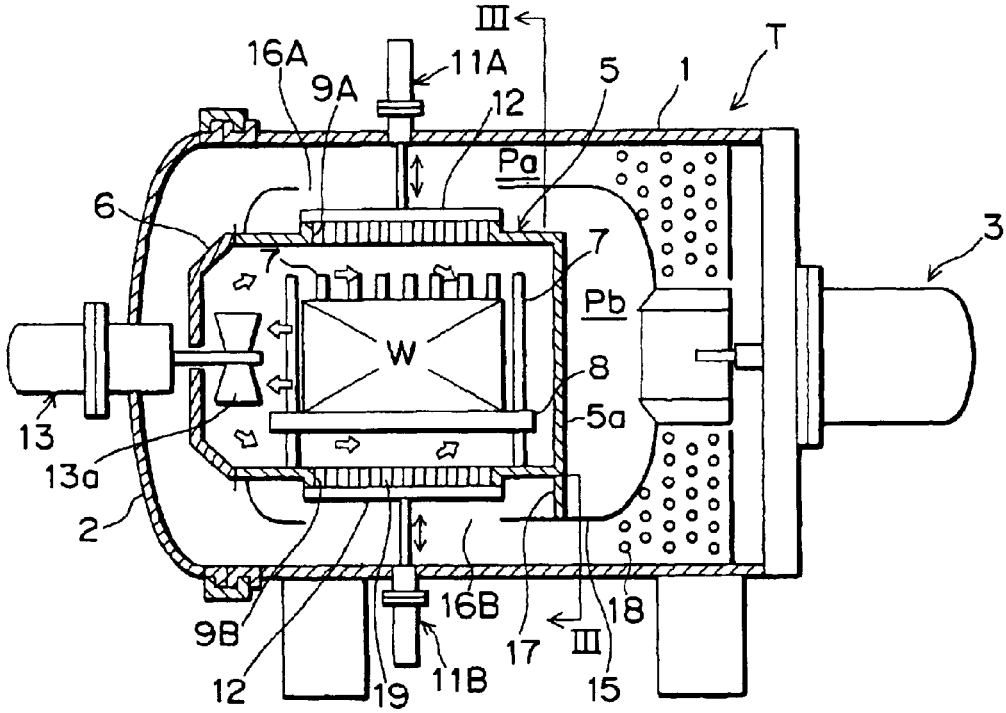
FIG. 1 is a sectional view showing a state of the gas-cooled single-chamber type heat-treating furnace according to the present invention during heating.
Figure 2:
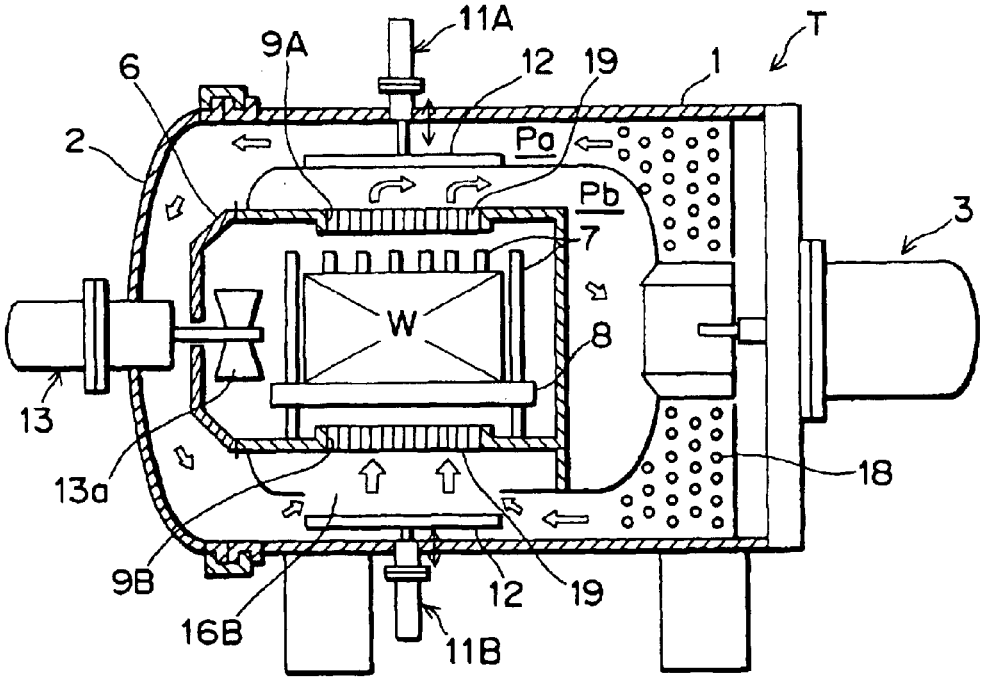
FIG. 2 is a sectional view showing a state of the gas-cooled single-chamber type heat-treating furnace according to the present invention during cooling.

In FIGS. 1 and 2, T denotes an internal circulation gas-cooled single-chamber type heat-treating furnace (hereinafter referred to as "heat-treating furnace") according to the present invention. In the casing 1, there is provided an inner chamber 5 which forms a processing room, and a charge/discharge door 2 equipped with a door 6 of the inner chamber 5 is provided on one side of the casing 1 and a circulating fan 3 for cooling is provided on the other side of the casing 1.

A heater 7 is provided inside the inner chamber 5. On a top and a bottom of the inner chamber 5, cooling gas vents (hereinafter referred to as "vents") 9A and 9B having a large area are provided so as to allow entry of a metallic material W of the maximum dimensions to be placed on a placing member 8. The vents 9A and 9B are opened and closed by means of lifting doors 11A and 11B respectively fitted to the casing 1.

The charge/discharge door 2 is equipped with a circulating fan 13 for heating, an impeller 13*a* of which is positioned inside the door 6 of the inner chamber 5.

Figure 3:
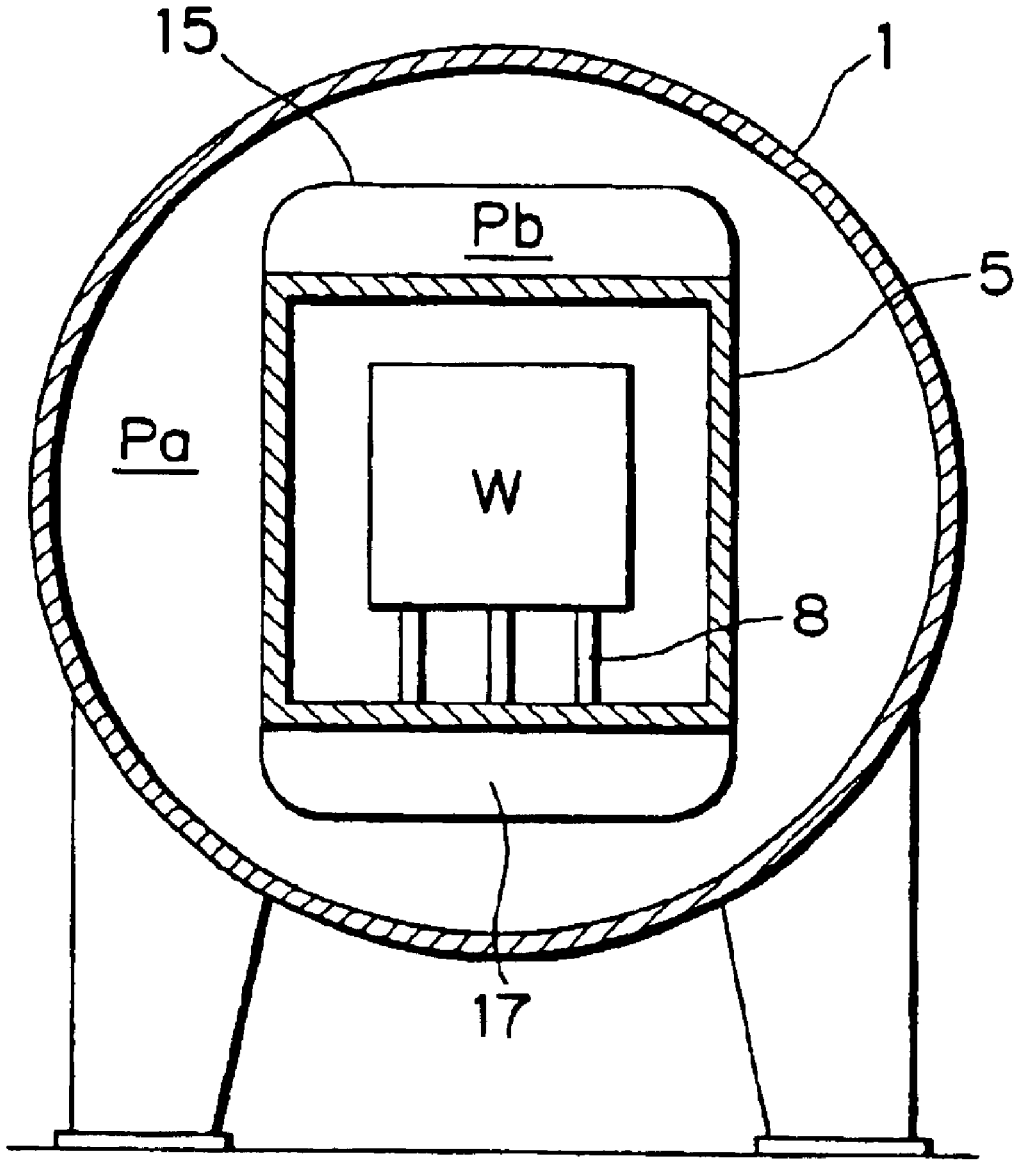
FIG. 3 is a sectional view taken along the line III—III in FIG. 1.

As shown in FIG. 3, a muffle 15 is provided in a region extending from end portions of upper and lower faces of the inner chamber 5 to a suction portion of the circulating fan 3 for cooling so as to cover the inner chamber 5. Furthermore, a space between a lower portion of a side wall 5*a* of the inner chamber 5 on a side of the circulating fan 3 for cooling and the muffle 15 is closed by a partition board 17, and thus an atmosphere exhaust passage Pa and an atmosphere suction passage Pb are formed between the casing 1 and the inner chamber 5. In addition, a cooler 18 is provided on a side of the circulating fan 3 or cooling of the atmosphere exhaust passage Pa, and portions of the muffle 15 opposed to vents 9A and 9B are provided with openings 16A and 16B having shapes similar to those of the pressing portions 12 of the doors 11A and 11B, respectively.

Figure 4:
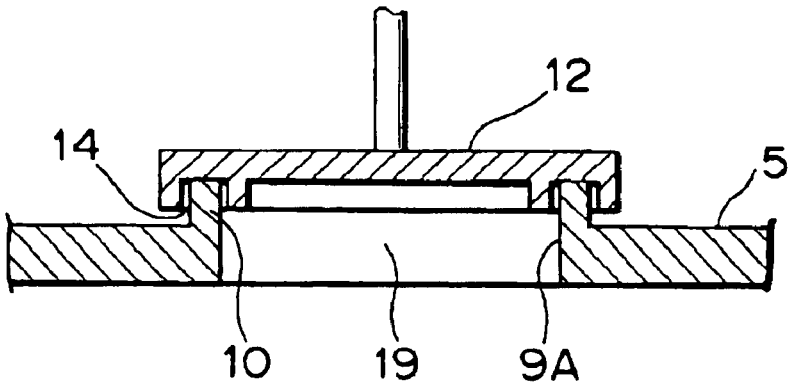
FIG. 4 is an enlarged partial sectional view showing the cooling gas vents of the inner chamber and the doors in FIG. 1.

As shown in FIG. 4, a projection 10 is formed on an outer peripheral portion of each of the vents 9A and 9B, while a recess 14 to be loosely engaged with the projection 10 is formed on each of the pressing portion 12 of the doors 11A and 11B. The width of the recess 14 is a little larger than that of the projection 10 so as to allow thermal expansion of the projection 10. When the doors 11A and 11B are closed, a tip portion of the projection 10 comes into pressing contact with a bottom portion of the recess 14.

Figure 5:
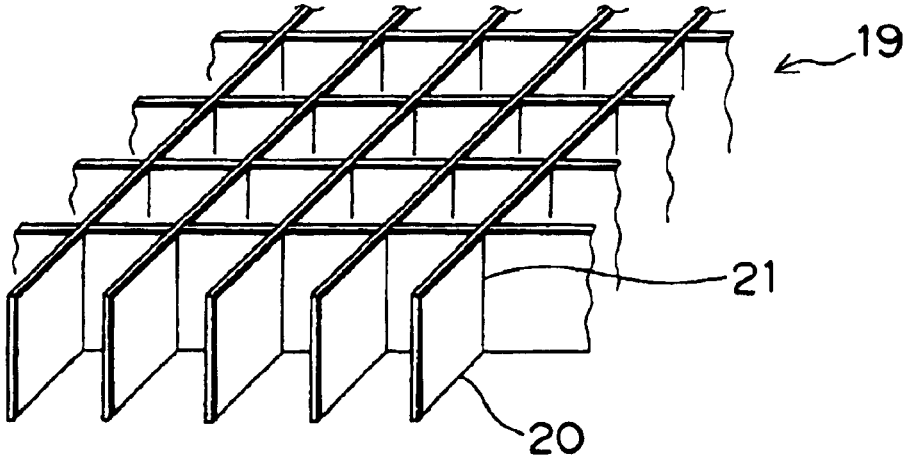
FIG. 5 is a perspective view showing the lattice-shaped flow uniforming members in FIG. 1.

As shown in FIG. 5, lattice-shaped flow uniforming members 19 are installed in the vents 9A and 9B.

The lattice-shaped flow uniforming member 19 is constituted by combining plates 20 made of heat-resisting material (e.g., heat-resisting steel or carbon graphite fiber composite) in a lattice shape by utilizing slits 21, and are installed slightly inside the vents 9A and 9B such that the doors 11A and 11B (the pressing portion 12) operate without any trouble.

Hereinafter, an operation method of the heat-treating furnace T of the above construction is described.

Firstly, the vents 9A and 9B are closed by the pressing portion 12 of the doors 11A and 11B and, the charge/discharge door 2 is opened together with the door 6 of the inner chamber 5, and then a metallic material W is charged into the inner chamber 5. Thereafter, the charge/discharge door 2 and the door 6 are closed and then, the heater 7 is turned on and the circulating fan 13 for heating is run. As a result, the atmosphere in the inner chamber 5 is circulated, whereby the metallic material W is heated. (FIG. 1).

During heating, if a clearance occurs between the inner chamber 5 and the pressing portions 12 of the doors 11A and 11B, respectively, it will affect the uniform heating of the metallic material W. However, as described above, since the inner chamber 5 and each of the pressing portions 12 have a construction in which a projection 10 is held in engagement with a recess 14, deformation of a tip portion of the projection 10 and a bottom portion of the recess 14 does not lead to excessive deterioration of a sealing performance and has little influence on a temperature distribution in the chamber 5.

When the metallic material W is heated to a predetermined temperature, the heater 7 is turned off, and then the circulating fan 3 for cooling is run after the vents 9A and 9B are opened by the lifting doors 11A and 11B.

In this case, the opening 16A provided in the muffle 15 is closed by the lifting door 11A and the opening 16B provided in the muffle 15 is opened by the lifting door 11B. (FIG. 2)

Accordingly, during cooling, the cooling gas discharged from the circulating fan 3 for cooling through the cooler 18 enters the inner chamber 5 through the opening 16B and the vent 9B after passing through the atmosphere exhaust passage Pa, and then sucked in by the circulating fan 3 for cooling after passing through the vent 9A and the atmosphere suction passage Pb.

As described above, since the vents 9A and 9B are provided with the lattice-shaped flow uniforming members 19 by which flow of the cooling gas is uniformed and the cooling gas is discharged from the vent 9A while a state of its uniform flow is being maintained, the metallic material W is cooled uniformly.

A material of the lattice-shaped members 19 may be a heat-resisting steel plate. On the other hand, it is necessary to increase the gas pressure in the inner chamber 5 or the volume of the circulated cooling gas to enhance the cooling effect of the metallic material W. If the thickness of the heat-resisting steel plates is increased so as to withstand such a gas pressure or volume of the circulated cooling gas, the heat accumulation of the lattice-shaped flow uniforming members 19 increases, so that responsiveness to temperature changes during heating and cooling lowers and heat loss increases. Therefore, it is preferable to make the lattice-shaped flow uniforming members 19 of thin plates of carbon graphite fiber composite.

Furthermore, in case the lattice-shaped flow uniforming member 19 is constructed by combining plates, another effect that each lattice can be adjusted in size etc. is also obtained.

Figure 6:
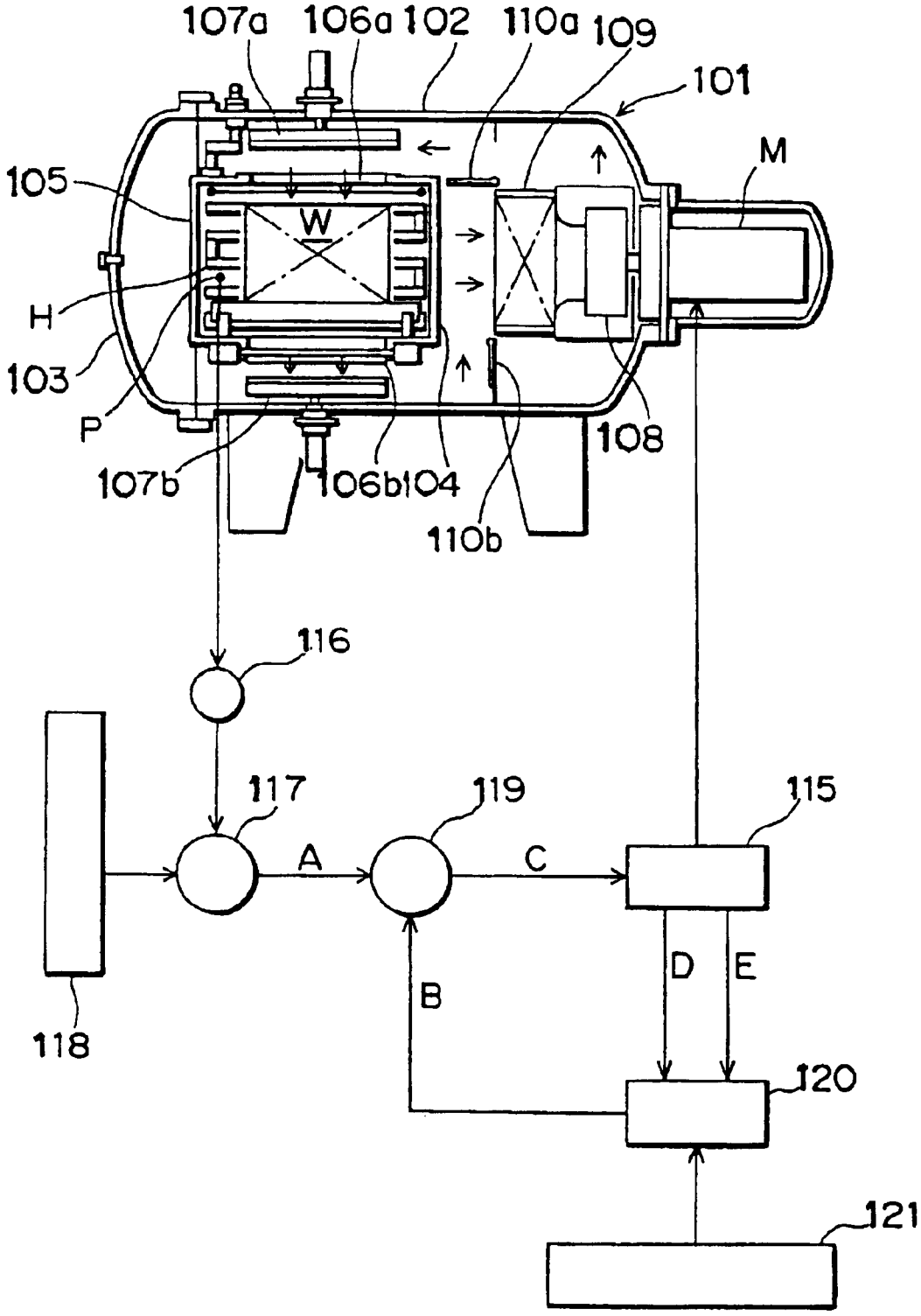
FIG. 6 shows the gas-cooled single-chamber type heat-treating furnace and its control circuit to which a gas cooling method of a metallic material according to the present invention is applied.

FIG. 6 shows an internal circulation gas-cooled single-chamber type vacuum heat-treating furnace 101 to which the gas cooling method of metallic material according to the present invention applies.

In the single-chamber type vacuum heat-treating furnace 101, an inner chamber 104 forming a processing room is provided within a casing 102. Furthermore, a charge/discharge door 103 having a door 105 of the inner chamber 104 is provided on one side of the casing 102, and the drive motor M of a circulating fan 108 for cooling is provided on the other side of the casing 102. Then, the circulating fan 108 for cooling is run by the drive motor M.

Meanwhile, in FIG. 6, a reference numeral 109 denotes a cooler provided in front of the circulating fan 108 for cooling and each of reference numerals 110*a* and 110*b* denotes a damper.

A heater H is arranged inside the inner chamber 104, and openings 106*a* and 106*b* are provided at a top and a bottom of the inner chamber 104, respectively. The openings 106*a* and 106*b* are opened and closed by lifting doors 107*a* and 107*b*, respectively.

As illustrated, in case the one damper 110*a* is in a horizontal state and the other damper 110*b* is in a vertical state, the cooling gas is supplied from the opening 106*a* into the inner chamber 104, and then the cooling gas in the inner chamber 104 is directed to the cooler 109 through the opening 106*b*. Alternatively, in case the one damper 110*a* is in a vertical state and the other damper 110*b* is in a horizontal state, the cooling gas is supplied from the opening 106*b* into the inner chamber 104, and then the cooling gas in the inner chamber 104 is directed to the cooler 109 through the opening 106*a*.

An inverter 115 is connected to the drive motor M of the circulating fan 108 for cooling. The inverter 115 has two functions of output frequency control and output power control. That is, the drive motor M is run by feedback control based on the atmosphere temperature or metallic material temperature in the inner chamber. Furthermore, such a control is performed that when the drive motor M has reached a critical output state, an actual electric power value of the drive motor is fed back so as to be kept to run at the critical output even if the load of the drive motor M increases due to a temperature change.

Hereinafter, the gas cooling method of a metallic material applied to the gas-cooling single-chamber type vacuum heat-treating furnace 101 constructed as mentioned above is described together with a control circuit for the drive motor M of a cooling fan.

Firstly, the charge/discharge door 103 is opened together with the door 105 of the inner chamber 104, and then a metallic material W is charged into the inner chamber 104. Thereafter, the charge/discharge door 103 and the door 105 are closed. Furthermore, the inside of the inner chamber 104 is brought into a state of a predetermined degree of vacuum by an unillustrated means and, under this condition, the metallic material W is heated by a heater H. In this case, the lifting doors 107*a* and 107*b* are closed.

When the metallic material W reaches a predetermined temperature, the heater H is turned off and the inside of the casing 102 is brought back to a state of an initial pressure. Then, the lifting doors 107*a* and 107*b* are opened, and the one damper 110*a* is brought into a horizontal state, while the other damper 110*b* is brought into a vertical state, and thus the metallic material W is cooled by the circulating fan 108 for cooling on the basis of a predetermined cooling curve.

More specifically, the furnace atmosphere temperature is detected by a temperature sensor P and a detected temperature signal is inputted to a temperature controller 117 through a converter 116. In the temperature controller 117, the detected temperature signal is compared with a preset temperature signal inputted beforehand from a program setter 118, and a preset number of revolutions signal A for eliminating the difference between these signals is inputted to a signal selector 119 from the temperature controller 117.

Furthermore, an actual voltage and an actual electric current of the drive motor M of the circulating fan 108 for cooling are detected by an unillustrated means. Detected actual voltage signal D and detected actual electric current signal E are inputted to an output power operating regulator 120 which calculates an actual power. In the output power operating regulator 120, the actual power is compared with a preset value of a critical power inputted beforehand from the critical power setter 121. If the actual power≧the critical power, the output power operating regulator 120 outputs a preset number of revolutions signal B which indicates a value subtracting a number of revolutions corresponding to a difference between the above powers to prevent a burnout of the drive motor M of the circulating fan 108 for cooling. On the contrary, if actual power<the critical power, the output power operating regulator 120 outputs the preset number of revolutions signal B which indicates a value adding a number of revolutions corresponding to the difference between the above powers because the number of revolutions is allowed to be raised further. Meanwhile, it is possible to change the critical power in accordance with a continuous operating time at the maximum critical output or specifications etc. of the drive motor M of the circulating fan 108 for cooling.

The preset number of revolutions signal B from the output power operating regulator 120 is inputted to the signal selector 119, in which the preset number of revolutions signal B is compared with the preset number of revolutions signal A from the temperature controller 117. As a result, if the preset number of revolutions signal A≦the preset number of revolutions signal B, a preset number of revolutions signal C equal to the preset number of revolutions signal A is outputted from the signal selector 119, while if the preset number of revolutions signal A>the preset number of revolutions signal B, a preset number of revolutions signal C equal to the preset number of revolutions signal B is outputted from the signal selector 119. This output signal is inputted to the inverter 115 on the basis of which the number of revolutions of the drive motor M of the circulating fan 108 for cooling is controlled.

Once the circulating fan 108 for cooling is run by the drive motor M of the circulating fan 108 for cooling, the atmosphere in the single-chamber type vacuum heat-treating furnace 101 is directed to a cooler 109 by the dampers 110*a* and 110*b* and is cooled during passing the cooler 109. Then the cooled atmosphere is circulated in the furnace so that the metallic material W is cooled.

Upon completion of a predetermined heat treatment, the drive motor M of the circulating fan 108 for cooling is stopped. Then the charge/discharge door 103 is opened, and the metallic material W is discharged out of the furnace.

The gas cooling method of a metallic material according to the present invention is not limited to the method mentioned above and, includes a gas cooling method in which a surface temperature is employed as the temperature to be feedback instead of the above-mentioned furnace atmosphere temperature. Furthermore, an external circulation type furnace may be employed in which such cooling apparatuses as the circulating blower and the cooler 109, instead of the circulating fan 108 for cooling is installed outside the furnace and, the furnace and the cooling apparatuses are connected by a duct.

Furthermore effective control may be realized by combining the above-mentioned control and furnace pressure control.

What is claimed is:

1. A gas-cooled single-chamber heat-treating furnace, comprising:

cooling gas vents opened and closed by doors provided on each of mutually opposed walls of an inner chamber forming a processing room;

a first circulating fan located outside one end portion of the inner chamber, and a second circulating fan being located inside an opposite end portion of the inner chamber, the end portions being substantially orthogonal to the cooling gas vents provided in the mutually opposed walls; and cooling gas being circulated by the first circulating fan by opening the cooling gas vents during gas cooling, wherein the cooling gas vents of the inner chamber are provided with lattice-shaped flow uniforming members made of heat-resisting materials.

2. The gas-cooled single-chamber type heat-treating furnace as claimed in claim 1, wherein the cooling gas vents are provided at an upper portion and a lower portion of the inner chamber;

wherein the doors are of a lifting type; and wherein a pressing contact portion between a peripheral portion of the each door and the inner chamber has a structure in which a projection is held in engagement with a recess.

3. The gas-cooled single-chamber type heat-treating furnace as claimed in claim 1 or 2, wherein the lattice-shaped flow uniforming members are made of thin plates of carbon graphite fiber composite.

4. A gas cooling method in a gas-cooled single-chamber type heat-treating furnace in which a metallic material heated to a hardening temperature is cooled in a furnace atmosphere by forced convection, the method comprising the steps of:

controlling a number of revolutions of the drive motor of a circulating fan for cooling or a circulating blower based on a difference between a preset cooling curve and an atmosphere temperature in the furnace or a metallic material temperature in the furnace obtained by comparing the atmosphere temperature or the metallic material temperature with the preset cooling curve; and keeping the drive motor running at its critic output even if a load increases due to a temperature change when an output of the drive motor reaches the critical output.

5. The gas-cooled single-chamber type heat-treating furnace as claimed in claim 1, further comprising:

a muffle provided in a region extending from the end portions of the mutually opposed walls of the inner chamber to a suction portion of the first circulating fan for cooling, the muffle covering the inner chamber.

6. The gas-cooled single-chamber type heat-treating furnace as claimed in claim 5, further comprising:

a space between the end portion of the inner chamber on a side of the first circulating fan for cooling and the muffle, the space being closed by a partition board, and thus forming an atmosphere exhaust passage and an atmosphere suction passage between the inner chamber and a casing surrounding the inner chamber.

* * * * *